US008723683B2

(12) United States Patent
Crossman et al.

(10) Patent No.: US 8,723,683 B2
(45) Date of Patent: May 13, 2014

(54) ILLUMINATED FIRE EXTINGUISHER CABINET

(75) Inventors: Floyd W. Crossman, Hillsborough, NJ (US); Benjamin Collar, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 330 days.

(21) Appl. No.: 13/173,865

(22) Filed: Jun. 30, 2011

(65) Prior Publication Data

US 2013/0002440 A1 Jan. 3, 2013

(51) Int. Cl.
*G08B 23/00* (2006.01)

(52) U.S. Cl.
USPC ..... 340/693.11; 340/628; 340/693.5; 340/693.9

(58) Field of Classification Search
USPC ..... 340/628, 627, 693.5, 693.9, 693.11
See application file for complete search history.

(56) References Cited

U.S. PATENT DOCUMENTS

| | | | | |
|---|---|---|---|---|
| 4,015,250 | A * | 3/1977 | Fudge | 169/23 |
| 4,303,218 | A * | 12/1981 | Naegeli | 248/146 |
| 4,649,376 | A * | 3/1987 | Frank | 340/691.1 |
| 4,787,460 | A * | 11/1988 | Clarkson | 169/51 |
| 5,153,567 | A * | 10/1992 | Chimento | 340/691.5 |
| 5,638,906 | A * | 6/1997 | McCabe | 169/51 |
| 5,775,430 | A * | 7/1998 | McSheffrey | 169/30 |
| 5,921,645 | A * | 7/1999 | Lapi | 312/245 |
| 5,952,919 | A * | 9/1999 | Merrill | 340/539.18 |
| 6,641,286 | B2 * | 11/2003 | Hincher, Sr. | 362/253 |
| 6,829,513 | B2 | 12/2004 | Piersanti et al. | |
| 6,977,596 | B1 * | 12/2005 | Brown | 340/693.6 |
| 7,800,511 | B1 * | 9/2010 | Hutchison et al. | 340/691.1 |
| 2008/0262816 | A1 | 10/2008 | Lontka | |
| 2013/0180139 | A1 * | 7/2013 | Underwood | 40/543 |

* cited by examiner

*Primary Examiner* — Travis Hunnings

(57) ABSTRACT

A cabinet for a fire extinguisher located in a building. The cabinet includes a housing having a door and a dome light located in an interior of the housing. The cabinet also includes an exterior light located on the door and a status light for indicating whether the cabinet is operating properly as a notification device. A fire safety system is also provided, wherein the fire safety system includes detectors for detecting an unsafe condition in the building and notification devices for providing notification of the unsafe condition. When an unsafe condition is detected, the interior and exterior lights are turned on to provide notification of the unsafe condition.

20 Claims, 4 Drawing Sheets

ILLUMINATED FIRE EXTINGUISHER CABINET

FIELD OF THE INVENTION

This invention relates to fire safety systems for a building, and more particularly, to a fire extinguisher cabinet including interior and exterior lights which is configured as a notification appliance.

BACKGROUND OF THE INVENTION

Conventional building fire safety systems include a number of fire detectors positioned throughout a building. Signals from the detectors are monitored by a system controller which, upon sensing an alarm condition, activates audible alarms throughout the building. Flashing light strobes may also be activated throughout the building to provide a visual alarm indication.

Buildings also include firefighting equipment which is located in various locations throughout the building. The firefighting equipment is available for use by a first responder when they arrive at the building or by other personnel. However, the firefighting equipment is frequently hard to find in low light situations which may occur during a building emergency. Further, visibility of the firefighting equipment may be reduced or blocked due to smoke resulting from a fire in the building. This hinders the efforts of first responders in locating the firefighting equipment during an emergency.

SUMMARY OF THE INVENTION

An illuminated cabinet for a fire extinguisher located in a building is disclosed. The cabinet includes a housing having an interior light and a door and an exterior light located on the door. A fire safety system is provided having detectors for detecting an unsafe condition in the building and notification devices for providing notification of the unsafe condition. When an unsafe condition is detected, the interior and exterior lights are turned on to provide notification of the unsafe condition.

DESCRIPTION OF THE INVENTION

Figure 1B:
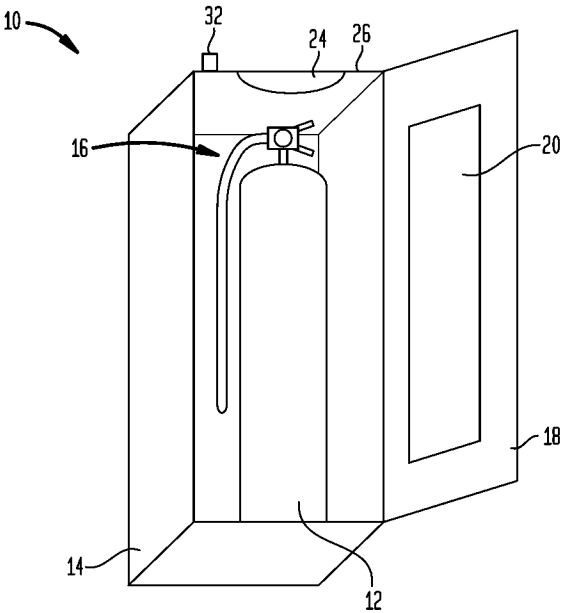
FIGS. 1*a* and 1*b* depict a cabinet having an interior dome light and an exterior light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

The embodiments disclosed herein will be described with respect to a fire safety system and related apparatus and methods. However, the invention is not limited to fire safety systems, and the exemplary and other various embodiments may be applied to any building system within the scope of the attached claims. In the description below, like reference numerals and labels are used to describe the same, similar or corresponding parts in the several views of FIGS. 1-4.

Figure 1A:
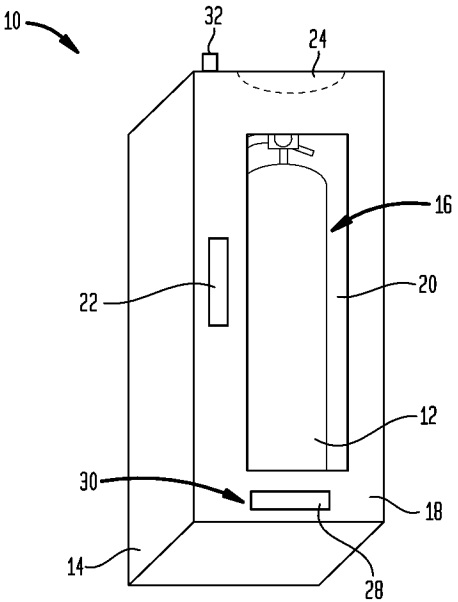

Referring to FIGS. 1*a* and 1*b*, a cabinet 10 for housing firefighting equipment such as a fire extinguisher 12 is shown. The cabinet 10 includes a housing 14 having an interior 16 for accommodating the fire extinguisher 12. The cabinet 10 also includes an access door 18 which may be opened by pulling on handle 22 in order to provide access to the fire extinguisher 12. The access door 18 includes transparent panel or window 20 so that the fire extinguisher 12 is visible when the access door 18 is closed. The housing 14 includes a dome light 24 located in a top interior portion 26 of the housing 14 for illuminating the interior 16 of the cabinet 10. The housing 14 also includes an exterior light 28 located on a lower portion 30 of the access door 18 for providing additional illumination. It is noted that the current invention is also applicable to cabinets which house other firefighting equipment such as fire axes, hoses and valves to which firefighters connect hoses.

The cabinet 10 is integrated into a fire safety system for a building and is configured as a notification appliance. The system includes a number of fire, smoke and other detectors positioned throughout the building. Signals from the detectors are monitored by a system controller which, upon sensing an alarm condition, turns on the dome 24 and exterior 28 lights for cabinets 10 housing fire extinguishers 12 located in the affected areas of the building. This serves to indicate an alarm condition to occupants in the building while also illuminating the cabinet 10 so that the fire extinguisher 12 housed in the cabinet 10 is easier to find in low light conditions. In addition, other devices such as audible alarms and flashing light strobes are also activated by the system to provide an indication of an alarm condition.

The housing 14 further includes a status light 32 for indicating whether the cabinet 10 is operating properly as a notification appliance. In particular, the status light 32 may be a light emitting diode (LED) which is turned off when the cabinet is operating properly as a notification appliance but which emits yellow or other suitable color light when turned on to indicate that the cabinet 10 is not operating properly.

Smoke resulting from a fire may rise and fill mid to upper portions of a room or a corridor in the building. As a result, an occupant may crawl on the floor or crouch down to avoid the smoke. In accordance with the present invention, the cabinet 10 is mounted sufficiently low on a wall of the room or corridor so that visibility of the exterior light 28 to an occupant crawling on the floor or in a crouched position is not reduced or blocked by smoke. In one embodiment, the exterior light 28 is configured to display "FIRE EXTINGUISHER" or other identification in order to facilitate location of the fire extinguisher 12 in the room or corridor during a building emergency. The exterior light 28 may also display directional arrows to indicate an evacuation route for the occupants. The cabinet 10 may be either flush or surface mounted to a wall.

Figure 2:
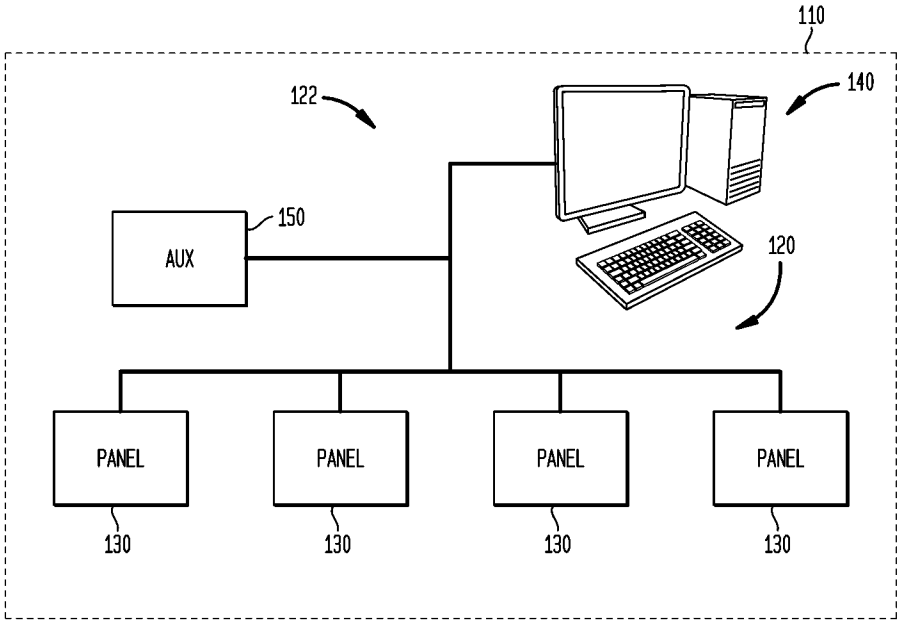
FIG. 2 shows a block diagram of a fire safety system installed at a facility.
Figure 3:
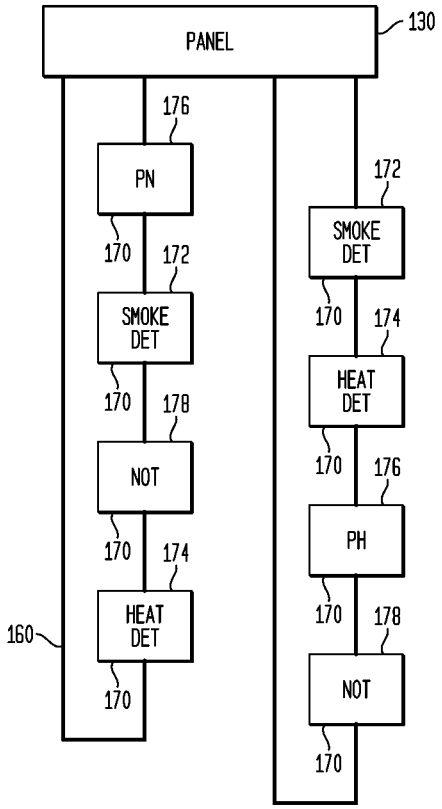
FIG. 3 shows a block diagram of hardware devices/modules connected to a control panel of the fire safety system of FIG. 2.

FIGS. 2 and 3 show an exemplary fire safety system 120 installed in a building or other facility 110. The system 120 is an integrated system that includes a plurality of control panels 130. The plurality of control panels 130 may be operably connected to at least one central control station 140. The control panels 130 and the control station 140 may also be operably connected to one or more auxiliary devices 150, such as a printer or other network device.

As shown in FIG. 3, each control panel 130 is connected to one or more hardware loops 160. Each loop 160 includes one or more fire safety devices 170 that perform any of a number of fire safety system functions. These functions may include, for example, smoke detection, fire detection, audible and visible notification of alarms, local control and communication, and other functions known in the art. The devices shown in the loop 160 of FIG. 2 include smoke detectors 172, heat detectors 174, manual pull handles 176, and notification devices 178 (including audible and visual alarms such as bells, sirens, lights, etc.). In accordance with the present invention, the cabinet 10, including the dome 24 and exterior 28 lights, is configured as a notification device 178. It will be recognized that different loops 160 will include different devices 170, and no loop needs to include any one particular device. The plurality of building control devices in each loop are connected in a single electrical circuit, each of the plurality of building control devices configured receive power provided from the associated control panel and communicate with the control panel (i.e., receive information from or provide information to the control panel).

The system 120 is generally operable to perform the detection and notification functions normally associated with fire alarm systems. As one of the functions, the fire safety devices 170 are operable to communicate event messages to the control panels 130 and then on to the central control station 140 over one or more communication networks. An event message typically communicates information regarding a non-normal condition. The event messages may relate to detected fire conditions, communication problems, equipment trouble, or other information that indicates that equipment within the system 120 requires action or further review. An event message may also include a "return to normal" message indicating that the non-normal condition referenced in a previously received event message has been resolved.

With particular reference now to FIG. 1, the system 120 is shown in a network environment 122 including a plurality of fire control panels 130 connected to a central control station 140. Each fire control panel 130 may operate in the network environment 122 using logical connections to one or more other fire control panels and the central control station 140. The network environment may be, for example, a LAN, a WAN, an intranet or the internet. The one or more fire control panels 130 and the central control station 140 are connected through a predetermined protocol which is dictated by the nature of the interconnect method and the panel types. Examples of protocols that may be used include the H-Net, M-Net and X-Net protocols as will be recognized by those of skill in the art. In one exemplary embodiment, panel to panel communications are on XNET while communications between modules within a panel are on HNET.

The network of FIG. 1 includes at least one personal computer (PC) based network monitoring and control location in the form of central control station 140. The PC 140 allows an operator to see events in the network 122 and also display graphics relative to the network 122 and individual control panels 130. The PC 140 also allows an operator to remotely control any or all of the fire control panels 130. Each of the fire control panels 122 in the network operate independently. Accordingly, the network 122 depicted in FIG. 1 will still operate if the PC 140 is not operational. Furthermore, although central control station 140 is shown within the confines of the facility 110 in FIG. 1, in other embodiments, the central control station 140 may be located outside of the facility 110 and tied into the network 122 via a remote connection.

When one panel 130 of the system 120 detects a system event from one of the fire safety devices 170, the panel 130 will broadcast the event to all of the other control panels 130. The other control panels 130 decide if that system event will cause a change on any of their local outputs. In an alternative embodiment, the system 120 may be configured such that one panel may control another panel's outputs directly.

The system 120 may be configured in a manner substantially similar to that described in U.S. Patent Publication No. 2008/0262816 A1 (U.S. application Ser. No. 12/148,868) entitled METHOD AND SYSTEM FOR TESTING A BUILDING CONTROL SYSTEM which is incorporated herein by reference in its entirety. Exemplary fire safety systems that may include or cooperate with the devices and be configured as described above include the Siemens FIREFINDER® XLS, MXL® and FS250™ fire detection systems. In addition, the system 120 is first planned and configured for the specific facility 110 using a system configuration tool. An exemplary system configuration tool is described in U.S. Pat. No. 6,829,513, the contents of which are incorporated herein by reference in their entirety. Exemplary configuration tools include the "CSGM" and "ZEUS" configuration tools provided by Siemens.

Figure 4:
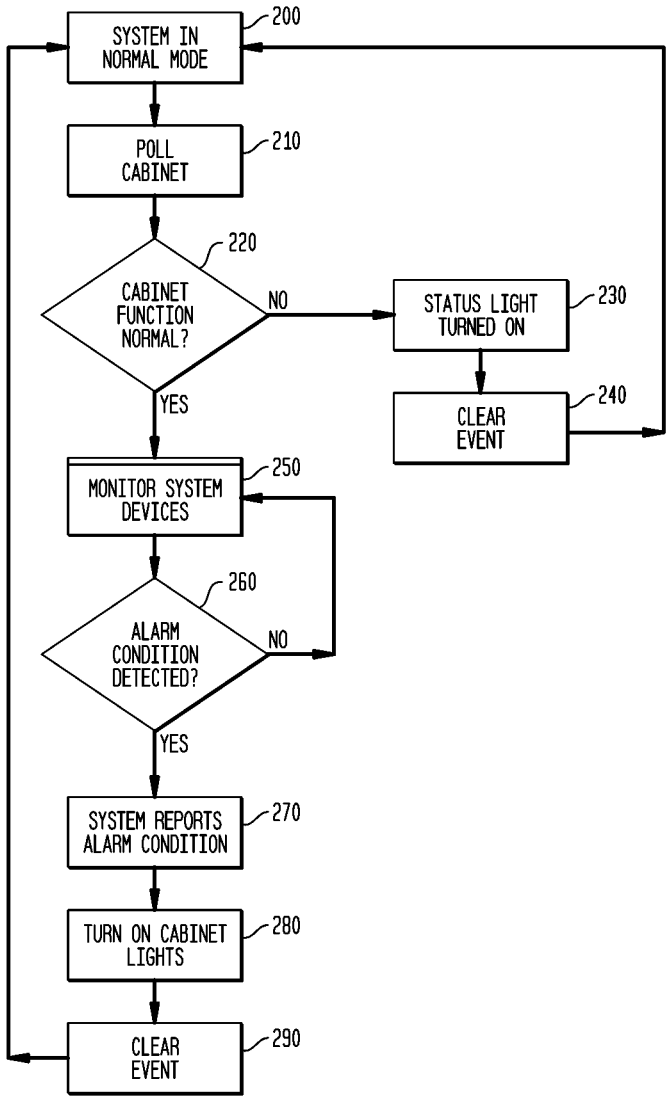
FIG. 4 depicts a method for operating the cabinet as a notification device.

Referring to FIG. 4, a method for operating the cabinet 10 as a notification device is shown. At step 200, the system 120 is in normal mode thus indicating that the system 120 is operating properly and no alarm conditions exist. At step 210, the system 120 periodically polls the cabinet 10 to verify that the cabinet 10 is operating properly as a notification device. If the cabinet 10 is not operating properly at step 220, the status light 32 is turned on to indicate a cabinet malfunction at step 230. Indication of a malfunction event is then reported by the system 120. Once proper operation of the cabinet 10 as a notification device is obtained, the malfunction event is cleared from the system 120 and the status light 32 is turned off at step 240. The cabinet 10 then returns to the normal mode at step 200. At step 210, the system 120 again polls the cabinet 10 at step 210 to verify that the cabinet 10 is operating properly as a notification device. If the cabinet 10 is operating properly, the system 120 monitors the devices 172,174,176 at step 250. At step 260, if any of the devices 172,174,176 are activated to indicate an alarm condition, the system 120 reports an alarm condition at step 270. When this occurs, the system 120 activates the notification devices 178 and sends a message to the cabinet 10 to turn on the dome 24 and exterior 28 lights at step 280. Once the alarm condition is no longer detected by the system 120, the alarm condition event is cleared from the system 120 at step 290 and the system 120 returns to its original state at step 200. If neither of the devices 172,174,176 is activated at step 260, the system 120 continues to monitor the devices 172,174,176 at step 250.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A cabinet for a fire extinguisher located in a building wherein the cabinet is operably connected to a fire safety system including a computer network having fire safety detectors for detecting a fire condition in the building, comprising:

a housing having an interior light and a door, wherein the housing is located remote from the fire safety detectors; and an exterior light located on the door, wherein when a fire condition is detected by the fire safety detectors of the fire safety system, the interior and exterior lights are turned on to illuminate the cabinet and provide notification of the fire condition.

2. The cabinet according to claim 1, wherein the interior light is a dome light.

3. The cabinet according to claim 1, further including a status light for indicating whether the cabinet is operating properly as a notification device.

4. The cabinet according to claim 3, wherein the status light is a light emitting diode.

5. The cabinet according to claim 1, wherein the exterior light provides a display for identifying the fire extinguisher.

6. The cabinet according to claim 1, wherein the exterior light further includes arrows for indicating an evacuation route for building occupants.

7. The cabinet according to claim 1, wherein the cabinet is positioned sufficiently low on a wall to enable viewing of the exterior light by occupants avoiding smoke while evacuating the building.

8. The cabinet according to claim 1, wherein the cabinet is surface mounted to a wall.

9. A cabinet for a fire extinguisher located in a building wherein the cabinet is operably connected to a fire safety system including a computer network having fire safety detectors for detecting a fire condition in the building, comprising:

a housing having a door, wherein the housing is located remote from the fire safety detectors;

a status light for indicating whether the cabinet is operating properly as a notification device;

a dome light located in an interior of the housing; and an exterior light located on the door, wherein when a fire condition is detected by the fire safety detectors of the fire safety system, the dome and exterior lights are turned on to illuminate the cabinet and provide notification of the fire condition.

10. The cabinet according to claim 9, wherein the status light is a light emitting diode.

11. The cabinet according to claim 9, wherein the exterior light provides a display for identifying the fire extinguisher.

12. The cabinet according to claim 9, wherein the exterior light further includes arrows for indicating an evacuation route for building occupants.

13. The cabinet according to claim 9, wherein the cabinet is positioned sufficiently low on a wall to enable viewing of the exterior light by occupants avoiding smoke while evacuating the building.

14. The cabinet according to claim 9, wherein the cabinet is surface mounted to a wall.

15. A method for operating a cabinet as a notification device in a building, comprising the steps of:

providing a housing having interior and exterior lights, wherein the housing stores firefighting equipment;

providing a fire safety system including a computer network having fire safety detection devices for detecting a fire condition in the building wherein the fire safety detection devices are located remote from the housing;

turning on the interior and exterior lights when the fire safety detection devices of the fire safety system detect a fire condition to illuminate the cabinet and provide notification of the fire condition.

16. The method according to claim 15, further including the step of providing a status light for indicating whether the cabinet is operating properly as a notification device.

17. The method according to claim 15, further including the step of displaying an identification of the firefighting equipment located in the housing.

18. The method according to claim 17, wherein the firefighting equipment is a fire extinguisher.

19. The method according to claim 15, further including the step of displaying arrows for indicating an evacuation route for building occupants.

20. The method according to claim 15, further including the step of positioning the housing sufficiently low on a wall to enable viewing of the exterior light by occupants avoiding smoke while evacuating the building.

* * * * *